US007192359B1

(12) United States Patent
Lundgren et al.

(10) Patent No.: US 7,192,359 B1
(45) Date of Patent: Mar. 20, 2007

(54) SYSTEM, COMPUTER PROGRAM PRODUCT AND METHOD FOR RECORDING AND ANALYZING PERFORMANCE DATA

(75) Inventors: Stefan Lundgren, Ängelholm (SE); Bengt Helmersson, Hjärnarp (SE)

(73) Assignee: Aimon AB, Angelholm (SE)

( * ) Notice: Subject to any disclaimer, the term of this patent is extended or adjusted under 35 U.S.C. 154(b) by 253 days.

(21) Appl. No.: 10/031,668

(22) PCT Filed: Jul. 18, 2000

(86) PCT No.: PCT/SE00/01501

§ 371 (c)(1),
(2), (4) Date: Jan. 18, 2002

(87) PCT Pub. No.: WO01/10518

PCT Pub. Date: Feb. 15, 2001

(30) Foreign Application Priority Data

Jul. 22, 1999 (SE) ..... 9902773

(51) Int. Cl.
*A63B 57/00* (2006.01)
*A63B 53/16* (2006.01)
*A63B 67/00* (2006.01)
*A63B 69/00* (2006.01)

(52) U.S. Cl. ..... 473/131; 473/140; 473/266; 473/415; 473/422; 473/453

(58) Field of Classification Search ..... 434/11–27, 434/29, 30, 33–35, 47, 307 R, 307 A, 322, 434/323, 335, 350, 312; 700/29–31, 91, 700/264; 473/151–156, 209, 221–223, 266; 84/470 R; 463/1–8, 36–38, 43, 49–57
See application file for complete search history.

(56) References Cited

U.S. PATENT DOCUMENTS 3,675,640 A * 7/1972 Gatts ..... 600/484

(Continued)

FOREIGN PATENT DOCUMENTS

JP 08-010374 1/1996

(Continued)

*Primary Examiner*—Corbett B. Coburn
*Assistant Examiner*—Sunit Pandya
(74) *Attorney, Agent, or Firm*—Boyle Fredrickson Newholm Stein & Gratz, S.C.

(57) ABSTRACT

A system, a computer program product and a method for registration and analysis of data from a practised stage, and for generation of action programs in dependence of said data. Preferably, the system and the method are adapted for the analysis of the player properties of a sports practiser (1500) and for the generation of an action program in the form of a training model for the player, whereby the player will, while practising (1501) the sport, register (1502) player data (101) and result data (102) in a registration unit (104). In a parameter processing unit (106), a player characteristics profile, depending of said registered data, is generated (1503), regarding various parameters, such as shot type, number of shots per shot type, etc., as well as a comparison profile by means of which a current player characteristics profile for a player is compared with a normal profile for an average player. In dependence of the comparison profile, an action program is automatically selected and presented (1504), aiming at eliminating the deviations from the normal profile by suggesting appropriate training (1505).

8 Claims, 9 Drawing Sheets

U.S. PATENT DOCUMENTS 3,717,857 A * 2/1973 Evans ..... 340/870.13
5,816,953 A * 10/1998 Cleveland ..... 473/459
5,947,869 A * 9/1999 Shea ..... 482/8
6,050,924 A * 4/2000 Shea ..... 482/57
6,059,672 A * 5/2000 Zeiner-Gundersen ..... 473/407
6,461,245 B1 * 10/2002 Morgan ..... 473/131
6,514,081 B1 * 2/2003 Mengoli ..... 434/252

FOREIGN PATENT DOCUMENTS

JP 9-215808 8/1997

* cited by examiner

SYSTEM, COMPUTER PROGRAM PRODUCT AND METHOD FOR RECORDING AND ANALYZING PERFORMANCE DATA

TECHNICAL FIELD

The present invention relates to a system and a method for automatically performing an analysis of registered data, and, also automatically, generating an action program, in dependence of the registered and analysed data. For example it is directed towards registration and analysis of sports practisers' game results and player properties, and generation of action programs, comprising training models, in dependence of said analysis and of game statistics regarding various game parameters. The invention is equally applicable to e.g. administrative routines for collection and processing of data, for the purpose of generating appropriate action.

STATE OF THE ART

Within many areas there exists a requirement for processing collected data, and for comparing it with existing statistics, with the aim of allowing a reasonable assessment of the collected data. For example in administrative or economical routines for enterprises, organisations, hospitals or authorities, registration of data from various parties is very frequent, e.g. business results, sales, staff turnover or similar. Concerned parties might be countries, enterprises, branch offices, departments, persons, etc. The registered data are often difficult to evaluate alone, and some characteristics or trends may be difficult or impossible to discern without a comparison with an equivalent group or reference. This type of administrative work is often both complicated and time-consuming, even if its results may be very useful for evaluation or for application of action programs for the purpose of improving various parameters.

Another area within which a corresponding problem exists is sports. There is, within most sports, a need for registration of results in the form of number of points, e.g. in tennis, or number of shots per course section or hole, e.g. in golf. This type of result registration is generally aimed at determining the winner of a competition stage. Another requirement for result registration is more directed towards analysing, based upon registered statistics, the playing properties of a player or a team, either for comparing with the properties of opponents or for supporting target-oriented training.

For different sports, there is today a multitude of different registration means available, ranging from paper forms to portable or stationary computer units. For golf e.g., there are portable electronic registration units for storage of the number of shots per hole, number of putts, type of club or shot length with each club. In some cases there are possibilities of transferring registered result data from a simpler registration unit to a more sophisticated computer, e.g. a personal computer, in order to facilitate collection and printing of statistics.

The patent publication U.S. Pat. No. 5,683,303, to Lambourne, discloses an electronic result registration apparatus for gold, wherein player data, such as name or initials and handicap, and result data, such as each player's number of shots per hole, putts per hole and won or lost holes per match, can be registered.

Also, the patent publication U.S. Pat. No. 5,795,237, to Miyamoto, discloses an electronic apparatus for entering golf course data and result data by means of a pen and a keyboard, and for presentation of golf results. This patent document, as well as the preceding one, is mainly aimed at registration of result data.

Another piece of known are, more particularly the patent document U.S. Pat. No. 5,558,333, to Kelson et al, discloses a system that is more focused on game improvement, based upon result data from real games. The system uses a microcomputer for displaying a graphical representation of a golf course, in order to register shot locations. Shot length and number of shots are registered, together with other game data, for subsequent analysis regarding possible improvements. What is presented as an analysis, however, only comprises a processing of the player's input data, e.g. a calculation and presentation of mean values. Furthermore, this system is rather complex, and time consuming for the user.

In "Golfing and your Palm Organizer" by Cox in Palm Power Magazine, December 1998, www.palmpower.com/issuesprint/issue199812/golf.html, a computer program is shown, which can be used together with a palm computer or a PC. With this computer program, player data and result data can be entered during a golf round, and statistics can be calculated and displayed.

In U.S. Pat. No. 5,810,680, to Lobb et al, a portable golf registration apparatus is disclosed, comprising a GPS receiver and a geographical information system. This apparatus also has the capacity of calculating statistics in dependence of result data.

In U.S. Pat. No. 5,882,269, to Lewis, a portable sports training aid means is disclosed, e.g. in the form of a PDA with associated software. On the aid means, a golfer may indicate result data, shot for shot. Statistics can be calculated and training tips can be issued in dependence of the player's result.

WO 97/42/588 to Westgard related to a method for automating the selection of a quality control procedure for analytical or clinical samples. According to the proposed method, a database of theoretical operating characteristics is provided, which operating characteristics can be described in terms of probabilities for acceptance of rejecting of samples as a function of errors in a method of measurement. An observed performance for a method of measurement is inputted in an algorithm wherein it is related to the theoretical operating characteristics from said database. Based thereon, control rules and numbers of control measurements are automatically selected, dependent on selection criteria.

OBJECT OF THE INVENTION

The invention is aimed at solving the problem of providing a system for efficient characterisation of the properties of a practiser of a certain stage. One aspect of the problem is to provide, based upon the property characteristics, a basis for improving the practiser's properties. Another aspect of the problem is to provide a basis for a sports practiser to obtain a clear and reliable presentation of his/her own characteristics.

SUMMARY OF THE INVENTION

According to an overall aspect, the invention relates to a system for registration and analysis of data from a practised stage, and for generation of action programs in dependence of the performed analysis. The stage could for example be a quality revision, an economic calculation, or a game round of some sport. The system comprises an input device, in the form of a registering unit, for entering result data. The result data will of course vary depending on the embodiment, but will comprise values of one or more predetermined parameters from one or several performed stages. A calculating device is connected to the input device and arranged to calculate, for each of said parameters, a characteristics measurement value for a predetermined characteristics measurement, in dependence of said result data. These could e.g. be measurement values of statistical entities, such as mean values, median values, extreme values, etc., for said parameters. A profile generation device, connected to said calculation device, is devised to generate a characteristics profile by compiling said calculated characteristics measurement values, and the system further comprises a reference database with a pre-stored normal characteristics profile. Said characteristics profile is a profile for practisers of said stage, whereas said normal characteristics profile is a profile calculated from a group of practisers with common properties, e.g. an average, a median value or an extreme value. A comparison device, connected to the profile generation device and the reference database, is arranged to generate a comparison profile by comparing said characteristics profile with said pre-stored normal characteristics profile. The system further comprises a selection device, connected to the profile generation device, functioning to select, in dependence of said characteristics profile or comparison profile, a pre-stored action program.

According to a preferred embodiment, the invention emanates from the inventors' realisation that such game statistics that is normally kept during a game round when practising some sport, e.g. the number of shots of various types in golf or tennis, could be used for creating a characterising profile of the properties of the player. This is based upon the knowledge that the result of a game round is not coincidental, but of course dependent on the skills and shortcomings of the player. The reliability of the profile will increase through using game statistics from a number of game rounds and calculating average values for various selected parameters.

In its most general form, the invention includes a system and a method comprising registration of result data in the form of values for one or several predetermined game parameters from one or several game rounds played. In the example of golf, the game parameters are typically different shot types, such as drives, transport shots, approach shots, putts, chip shots, bunker shots or penalty shots, and the parameter value is typically the number of shots per shot type. The registration may be made by means of electronic or mechanical means, or even with paper and pencil. For a number of selected game parameters, a characteristics measurement value is calculated for a predetermined characteristics measurement, e.g. the average number of shots per round, in total and per shot type. Subsequently, a characteristics profile for the player properties of the sports practiser is generated by compiling said calculated characteristics measurement values. This profile will thus provide a characteristic description of the playing performance of a player. For a human observer, the profile is preferably visualised graphically, e.g. in the form of a bar diagram or a curve, for example clearly presenting the average number of shots per round and the shot types. The profiles are adapted to the subject player regarding for example age, sex, playing performance, handicap, ranking or other player property.

In a further step, a comparison profile is generated for the sports practiser, by comparing said characteristics profile with a pre-stored normal profile for a normal player, having corresponding or better player data within the same age and sex group. This comparison profile will subsequently be the basis of a further step, wherein automatic selection and recommendation is performed of one or several pre-stored training models or action programs, intended to eliminate deviations in player properties, preferably player performance, from the comparison profile.

The selected parameters will of course be different for different sports, and such parameters should be selected that are appropriate for defining player quality from some aspect. For tennis e.g., the relative number of shots per shot type, the number of shots missed per shot type, ball touch-downs and ball hits, might be adequate parameters.

Various embodiments of the invention comprise a computer program product for controlling a computer to perform various portions of the method, and a system including hardware in combination with computer software.

Other characteristics and embodiments of the invention can be evident from the detailed description and the appended claims.

BRIEF DESCRIPTION OF THE DRAWINGS

The invention will now be explained in further detail, with reference to the enclosed drawings, of which.

DETAILED DESCRIPTION OF PREFERRED EMBODIMENTS

The present invention is, as was stated before, applicable to a multitude of different areas. In order to describe the invention as clearly as possible, substantially only sports embodiments will be discussed below, preferably the example of golf. This should not, however, be interpreted as if other embodiments were excluded from the scope of the invention. The described embodiments should rather be regarded solely as examples, and in order to call the reader's attention to one of the numerous other conceivable embodiments, a description of one embodiment of the invention within the area of revision in the health care sector is given further down in this description.

Figure 1:
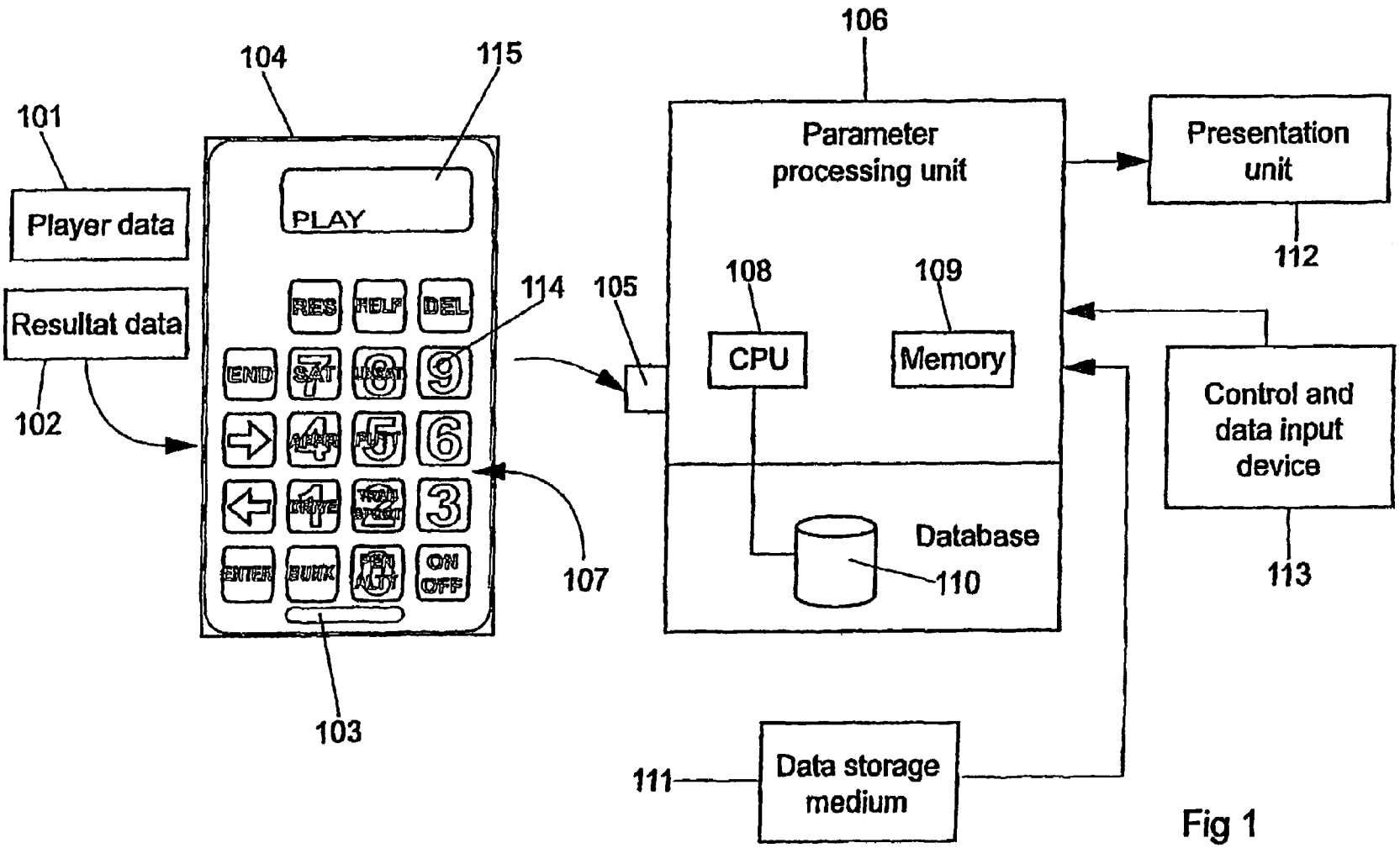
FIG. 1 shows an overall block diagram of an embodiment of the system according to the invention.

FIG. 1 shows an embodiment of the system according to the invention, comprising an electronic registration unit 104 for entering player data 101 and result data 102. As can be gathered from the figure, said data are entered via a keyboard 107 with keys 114 allowing input of various types of information. In its simplest form, the registration unit will only store stated data in various categories and the registering unit would be paper and pencil. The registration unit 104 further comprises a simple display 115, for presentation of input and processed data to the user. The system further includes a parameter processing unit 106 that, in various embodiments, can be partly or fully integrated in the electronic registration unit. In any occasion the parameter processing unit includes an input device 105 for receipt of result data and possibly player data. This could for example be performed by connecting a data output 103 of the registration unit to the input device 105. The parameter processing unit further includes data processing means in the form of a processing unit (CPU) 108 and a memory 109, and comprises, or is connected to, a database 110 containing pre-stored normal profiles. A presentation unit 112, in the form of a display or a printer, is also connected to the parameter processing unit, as is preferably a control and data input device 113 in the form of a keyboard, a mouse, or similar. In a preferred embodiment, the invention is realised in the form of a computer program product comprising a computer program, stored on a data storage medium 111 and functioning to control a data processing system, e.g. a personal computer, to perform the steps according to the invention. The parameter processing unit is then normally realised by means of a known PC and arranged according to the invention by means of the computer program product.

Figure 2:
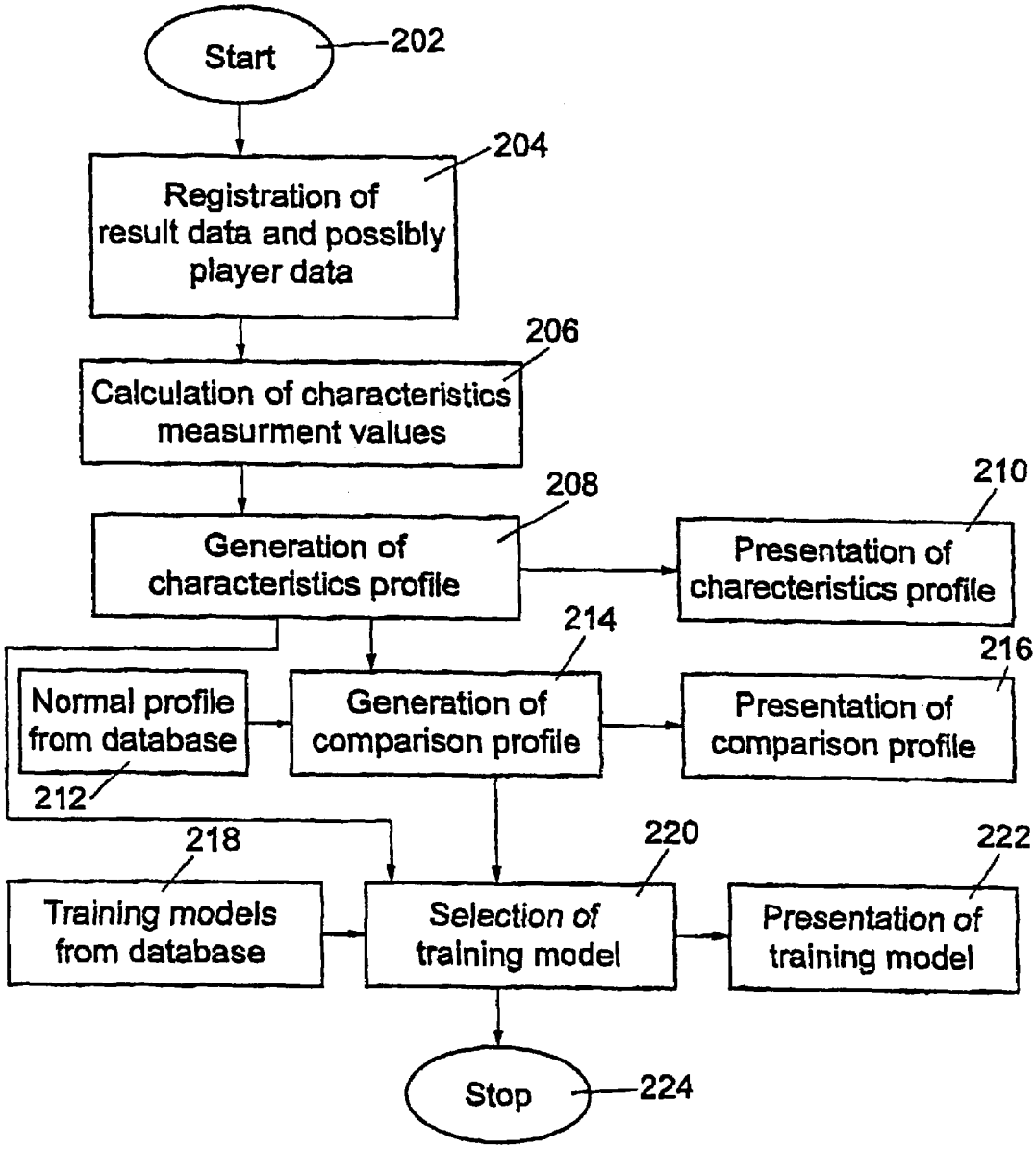
FIG. 2 shows a flow chart of the steps according to an embodiment of the invention.

FIG. 2 shows an overall flow chart of the method according to the invention. After Start 202, the following step numbers comprise:

204, registering result data, in the form of values for one or more predetermined game parameters, from one or several completed game rounds;

206, calculating, for every stated game parameter, a characteristics measurement value for a predetermined characteristics measurement;

208, generating a characteristics profile for the player properties of the sports practiser through compiling said calculated characteristics measurement values;

210, presenting, if requested, a graphic representation of the generated characteristics profile;

212, retrieving, from a database, a normal profile;

214, generating a comparison profile for the sports practiser by comparing said characteristics profile with a normal profile for a normal player, which normal profile is pre-stored in said database. In one embodiment, this step comprises the measure of applying a predetermined mathematical operation to the characteristics profile and the normal profile. The comparison profile can be realised in the form of a difference profile, generated by calculating the difference between the characteristics measurement values for each game parameter of the characteristics profile and the normal profile. In another embodiment, a comparison profile for the sports practiser is generated by compiling, for each game parameter, a current characteristics measurement value for the sports practiser, a stored best characteristics measurement value value for the sports practiser, and a normal characteristics measurement value for a normal player;

216, presenting, if requested, a graphic representation of the generated comparison profile;

220, selecting, in dependence of said characteristics profile or comparison profile, one or several pre-stored action programs, retrieved or fetched in step 218 from a database of pre-stored action programs, preferably in the form of training models;

222, presenting the selected action program to the user;

224, stopping and, if requested, repeating selected ones of the previous steps.

In one embodiment, player data for the sports practiser are registered, whereby said normal profile is based upon corresponding player data, for example, age group, sex, handicap or ranking. As mentioned above, the characteristics profile or comparison profile may be presented visually in the form of a bar diagram having one bar for each game parameter, where the bar height corresponds to the characteristics measurement value, or in the form of a corresponding curve chart.

Figure 10:
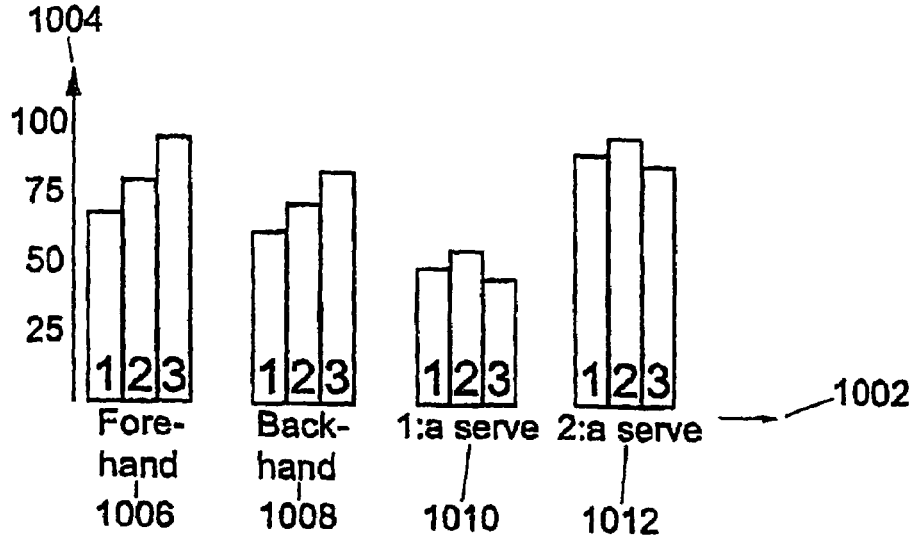
FIGS. 10–12 show examples of characteristics profiles and comparison profiles for tennis players.
Figure 11:
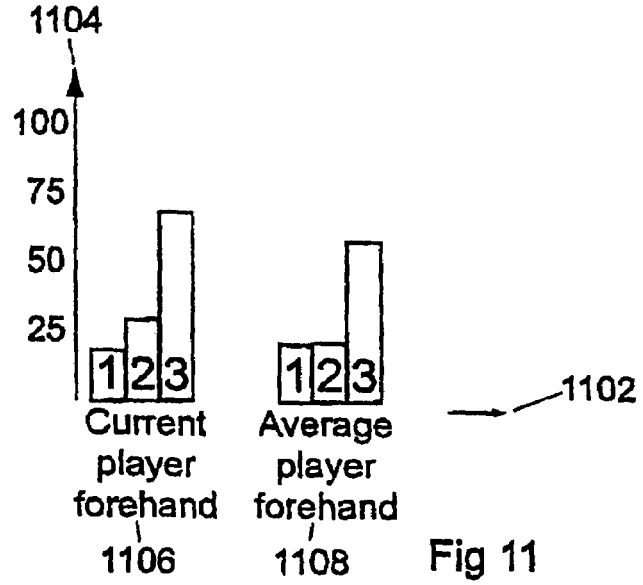
Figure 12:
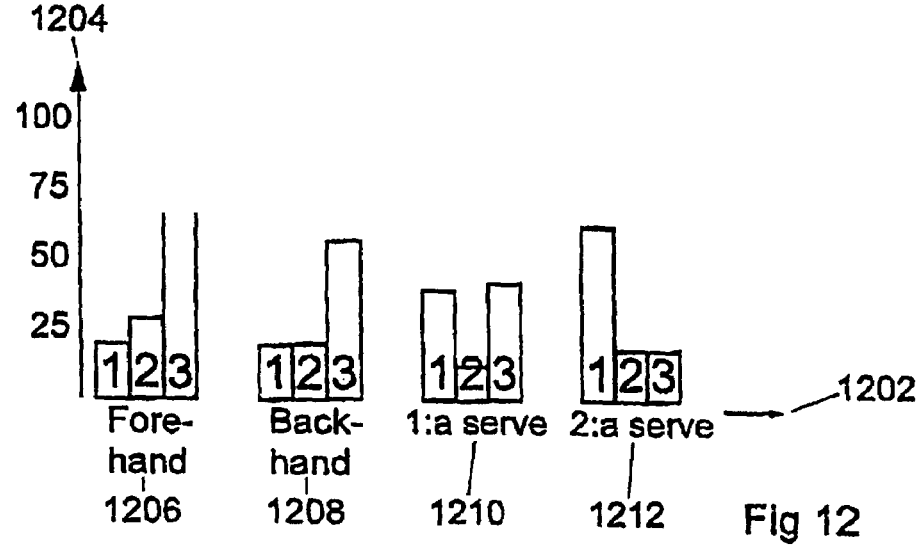

In the embodiment from which the exemplifying profiles in FIGS. 4–9 are collected, the invention is adapted for the analysis of a golfer's playing properties, the game parameters being various shot types and the characteristics measurement being the number of shots on average, per round. In another embodiment, from which the exemplifying profiles in FIGS. 10–12 are collected, the invention is adapted for the analysis of a tennis player's playing properties, the game parameters being various shot types and the characteristics measurement being the percentage distribution of successful shots in relation to unsuccessful ones.

Figure 3:
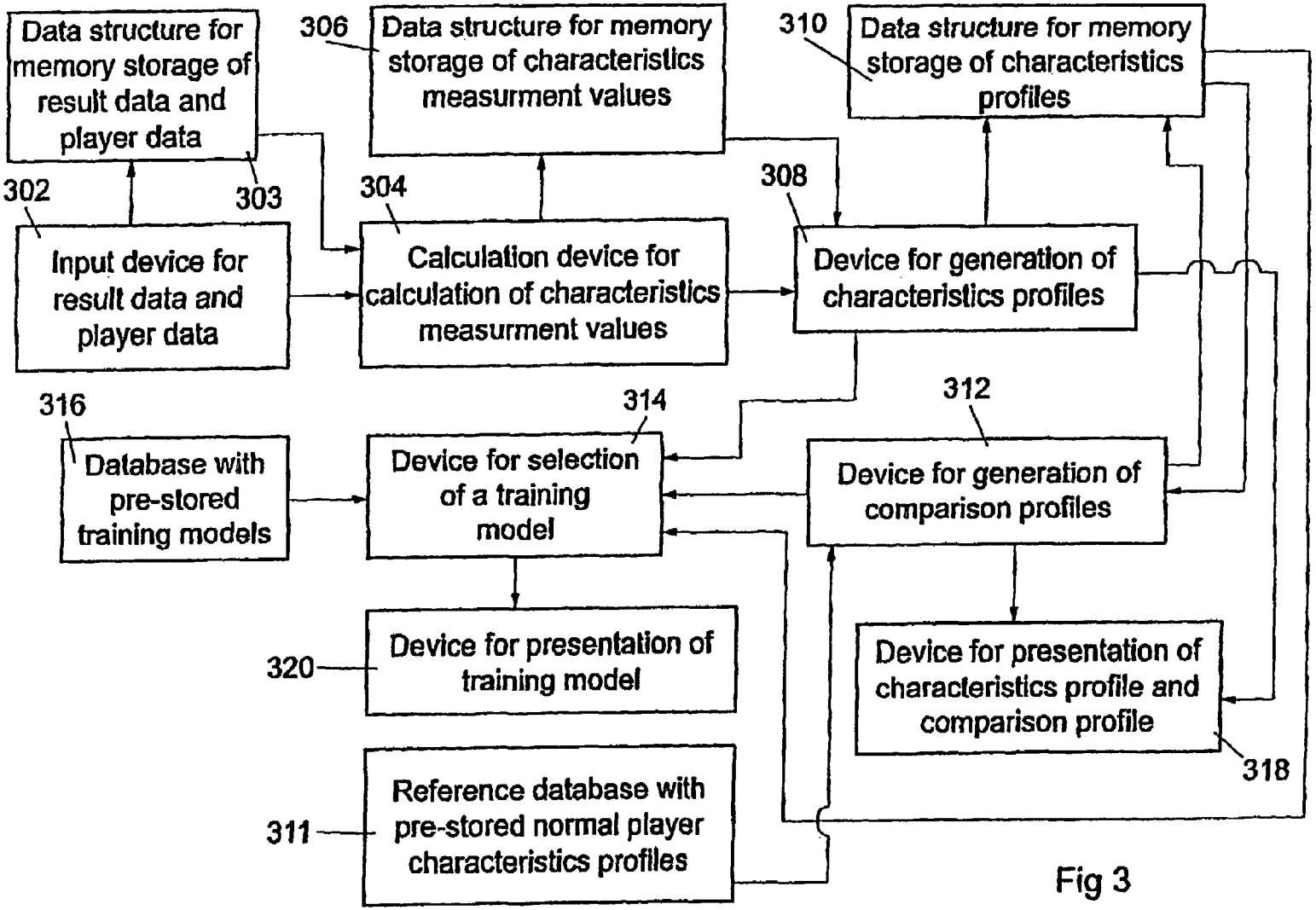
FIG. 3 shows an overall block diagram of devices comprised in embodiments of the invention.

FIG. 3 shows a block diagram for an apparatus or a computer program product according to the invention. In the apparatus embodiment, the devices will normally be realised by means of hardware components, possibly in combination with associated software. In the computer program product, the corresponding means will normally be realised through program instruction sequences stored on a storage medium and arranged for controlling a computer processing system into performing the actions according to the invention. The lines between the blocks of the block diagram indicate signal connections or communicative connections for signal or data communication between the devices.

The embodiment according to FIG. 3 comprises input device 302, for input and/or receipt of result data and player data, and a device 303 in the form of a data structure for storing said data in a memory. Further, a calculating device 304, for calculation of characteristics measurement values, and a device 306 in the form of a data structure for storing said characteristics measurement values in a memory, are included. The computing device 304 is devised to operate in dependence of said result data and/or player data from the input device 302 or the memory device 303. A device 308 for generation of a characteristics profile is devised to operate in dependence of the characteristics measurement values from the calculating device 304 or the memory device 306, and is in turn devised to store generated characteristics profiles into a device 310, in the form of a data structure for storing such characteristics profiles in a memory. Data structures for normal profiles, also called reference profiles, are pre-stored in a reference database 311. Further, a device 312, for generation of a comparison profile, receives a characteristics profile as input data from the memory 310 and a normal profile as input data from the reference database 311, and can in turn store a comparison profile into a memory device, e.g. 310. In dependence of the comparison profile, a device 314 then functions to select an action program among pre-stored action programs in an action database 316, preferably a training model database. Further to this, a device 318 for presentation of characteristics profiles and comparison profiles, and a device 320 for presentation of action programs, are included. The functionally described devices are, in various embodiments, adapted to the different functions described in other sections of this description of the invention.

Examples of graphic presentations, in the form of diagrams of characteristics profiles for a golf player, are shown in FIGS. 4–9 and 14, wherein the horizontal axis 402, 502, 602, 702, 802, 902, 1402, denotes game parameters such as shot type, and the vertical axis 404, 504, 604, 704, 804, 904, 1404, denotes the number of shots for a round, or preferably on average per round, on a certain golf course. The game parameters in these examples are the following different shot types:

Drive, 406, 506, 606, 706, 806, 906, 1406, consisting of a first shot, not intended to reach the golf green with its golf hole;

Transport, 408, 508, 608, 708, 808, 908, 1408, is the denomination for a shot type that is a continuation of an earlier shot and that is not intended to reach the green;

Approach, 409, 509, 609, 709, 809, 909, 1409, is a shot type with the intention of reaching the green, and which is not played from a bunker;

Putt, 410, 510, 610, 710, 810, 910, 1410, is a shot type used for the final shots, closest to the hole, generally on the green;

Bunker, 412, 512, 612, 712, 812, 912, 1412, is a shot type being shot from a gravel or sand obstacle on the course;

Penalty, 414, 514, 614, 714, 814, 914, 1414, is not a physical shot, but denotes how many extra penalty shots you have received due to your game on the course according to the present game rules.

Figure 4:
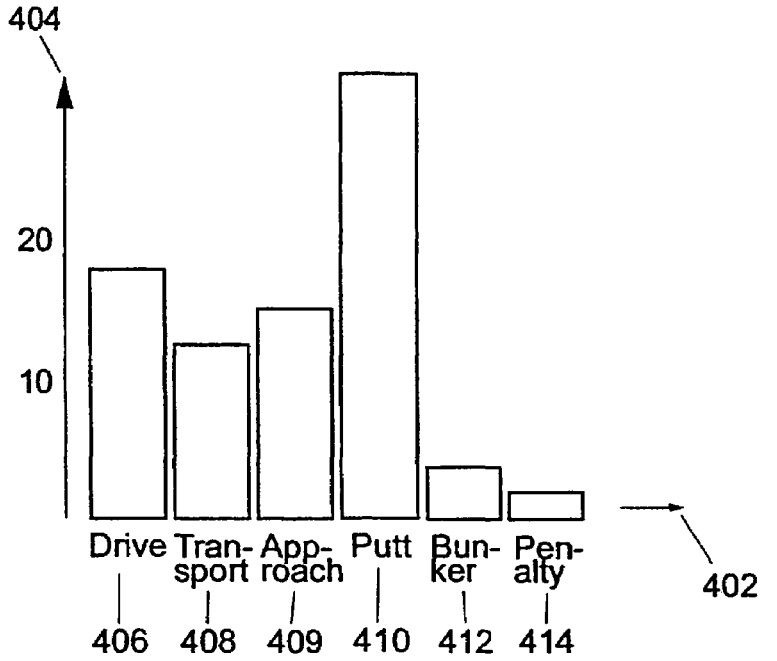
FIGS. 4–7 show examples of characteristics profiles for golf players, in the form of bar diagrams.
Figure 5:
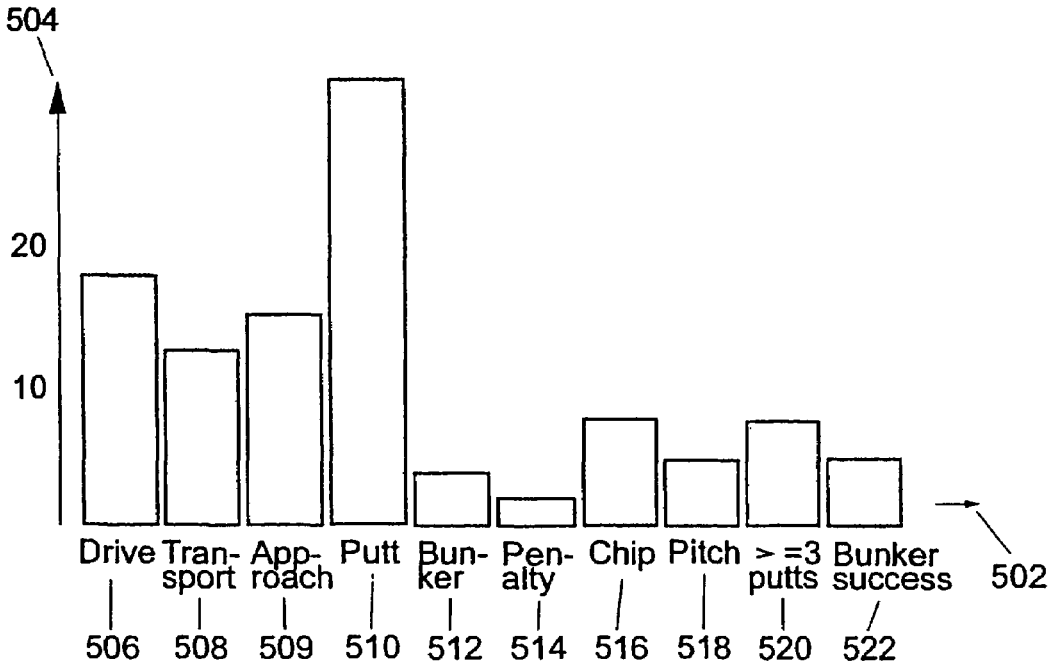

FIGS. 4 and 5 illustrate the current profile for an analysed player. In FIG. 5, the types of shot are also stated; the number of chip shots 516, i.e. a short shot with an iron club from a location close to the green, pitches 518, meaning a short, high shot with a highly angled club, and further two software-created shot types. The first of the latter two shows the number of shots caused by 3 or more putts on the same golf hole. The last shot type shows the number of successful bunker shots, on average, per round. A successful bunker shot may for example be defined by maximum one putt having been needed after the bunker shot.

Figure 6:
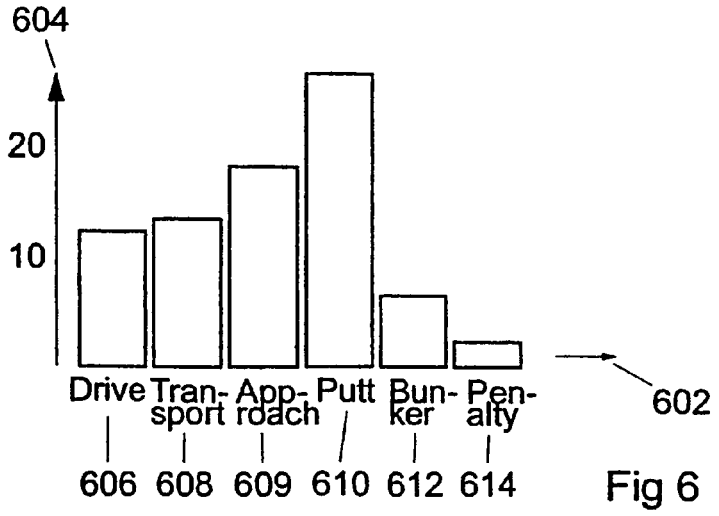
Figure 7:
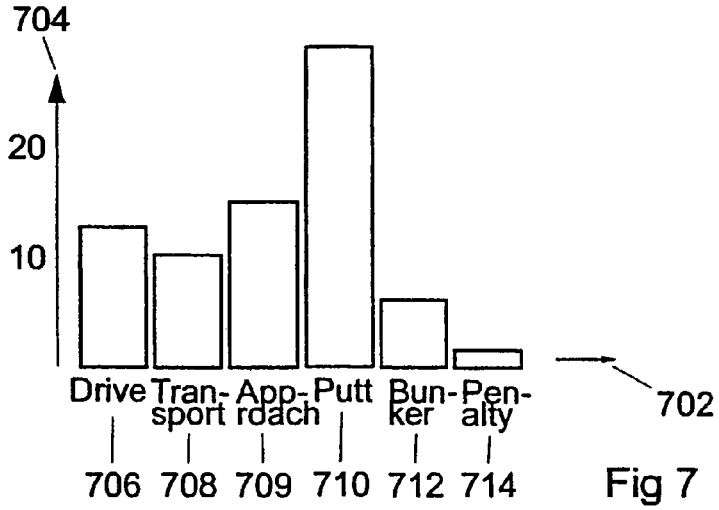

FIG. 6 again shows the current profile for an analysed player, and FIG. 7 shows a normal profile in the form of the profile for an average player, of the same sex and handicap level. From the reference database 311, several different normal profiles can of course be retrieved, compare step 212. Sex, age, handicap level, etc. may be selected, allowing a player to compare his own profile, i.e. playing characteristics, with a normal profile for a somewhat lower handicap. This will give the player an indication about what he/she ought to improve in order to reach a lower handicap, that is, become a better player.

Figure 8:
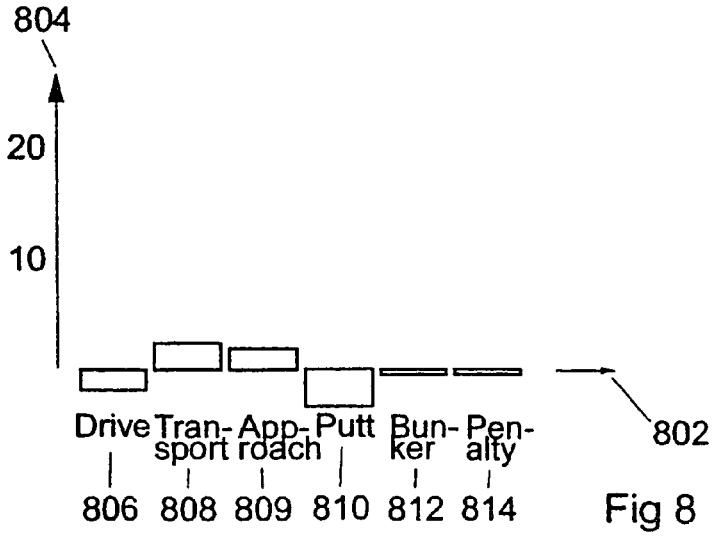
FIG. 8 shows an example of a comparison profile, more precisely a difference profile, for a golf player.

FIG. 8 shows a comparison profile, in the form of a difference profile, as a bar diagram where the average number of shots per round from the profile of FIG. 6 has been reduced by the corresponding characteristics measurement values from the normal profile of FIG. 7. The illustrated difference profile of FIG. 8 shows the highest value for the transport shot type, and the next highest one for the approach shot type, allowing the conclusion that it would be appropriate to select one or more action programs, i.e. training models, where these shot types are exercised.

Figure 9:
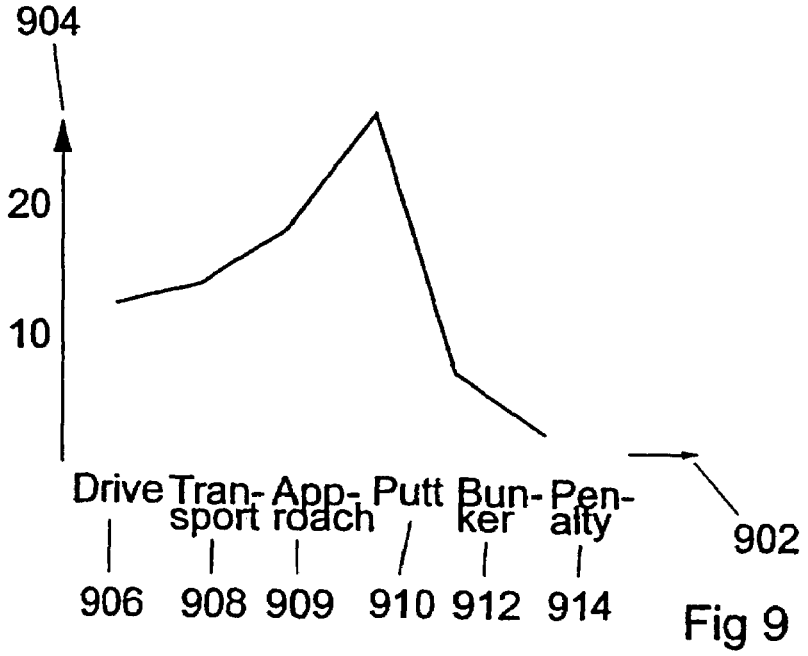
FIG. 9 shows an example of a characteristics profile for a golf player in the form of a curve chart.
Figure 14:
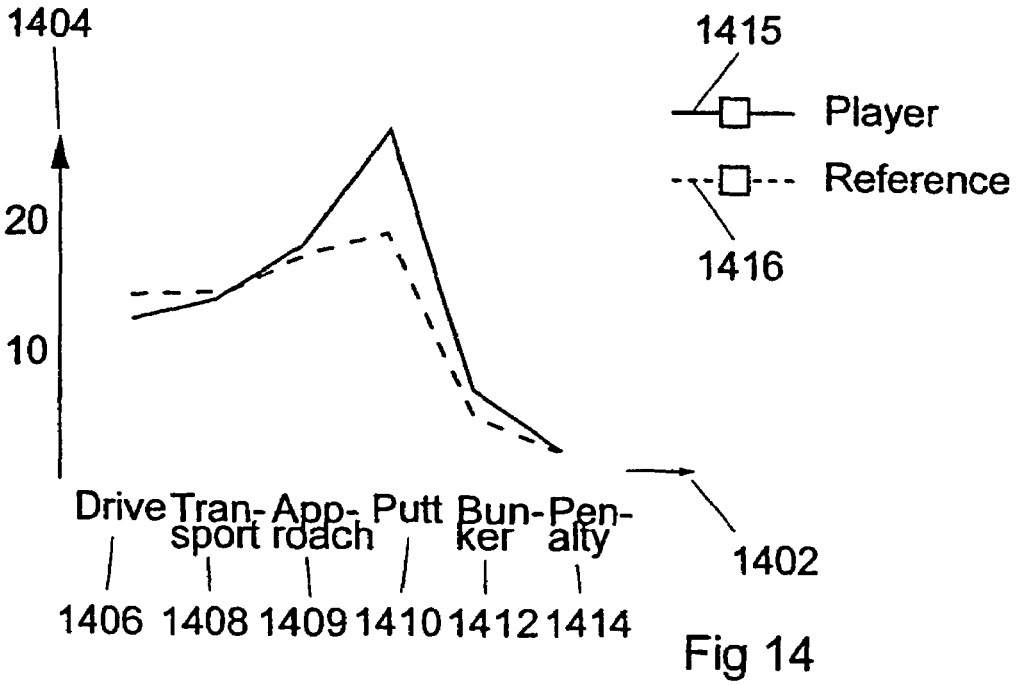
FIG. 14 shows an example of a comparison profile, wherein a characteristics profile for a golf player as well as a reference profile for a normal player are provided as separate curves in a curve chart.

FIG. 9 shows the same diagram as FIG. 6, but in the form of a curve. Another way of presenting a comparison profile, in accordance with FIG. 14, is to show the characteristics of the current player as well as that of the normal player, accessed from the reference database 311. Preferably, the bars, or the curves, as illustrated in the figure, are shown with different line types or colours, so as to make them easy to separate. The characteristics profile for the various cases may of course be represented in various diagram forms, depending on which will give the most suitable visualisation.

The graphical presentation, according to the present invention, of the player characteristics together with, or weighted against, a normal profile, allows a very clear and simple picture of which parts of the game are in need of improvement. The normal profile, or the reference profile, takes into consideration the number of holes with par 3, par 4 and par 5 on the present course that have been played, when calculating the player profile, thus ensuring the relevance of the given normal profile at all times.

The foregoing, i.e. input and calculation of player data, score, shot types, etc., and mathematical comparison between player profile and normal profile, could be called the analysis part of the system, and provide a most useful tool for the player in the ambition to improve his or her game. According to the invention, the system further comprises a training part, wherein input and analysed data are used for actively proposing an action program, e.g. in the form of training models for the player.

In a preferred embodiment of the invention, the practiser/player, or anyone else, for that matter, may proceed from the analysis part of the system to the training part in the parameter processing unit 106, by for example depressing a key on a keyboard 113, by a menu selection or by activating an icon on the presentation unit 112.

In the training part, advice is given on recommended training, depending on the player and reference profiles, i.e. the comparison profile. In a preferred embodiment of the invention, one or more exercise suggestions are provided, for a predetermined maximum number, e.g. 5, of shot types, said exercise suggestions being accessible by depressing a key, a menu selection or an icon activation. The exercises stored in the training database 316 are composed by golf pros, warranting a high and reliable quality. One or more training models with instructions and figures may thus be provided for a given comparison profile, and these training models may also be combined to provide a more complete training within an area where insufficiencies have been detected.

The parameters, in dependence of which exercises are suggested by the training part of the system, are e.g. sex, HCP (handicap) and area, i.e. course, range, etc. Preferably all, or the major portion of, this information will be retrieved from the analysis part of the system, but this information could also be entered directly to the training part via a keyboard 113 or similar.

For every suggested exercise, a written instruction is shown on the presentation unit 112, or on a printout if requested, and preferably one ore more figures in order to make the instruction as clear as possible. Besides this, every suggested exercise is accompanied by a comment about the player types, areas, HCP levels etc., which the exercise is suitable for.

In one embodiment of the invention, the analysis part of the system, and/or its training part, are accessible from an Internet portal, belonging to a service provider. Access to the portal may for example be controlled by subscription, in combination with a user name and a password, in the known manner. In a preferred embodiment, the players can also e-mail their registered game results, together with current player data, to the service provider administrating the Internet portal and the reference database 311. The service provider may then store the player data in the reference database 311, accessible via the portal, thereby increasing the statistical accuracy and the multitude of player types of the reference database.

In one embodiment of the present invention, the registration unit 104 may also be used for registration of the length and direction of golf shots. In a preferred embodiment, this is possible by means of the numerical keys 114 indicating the digits 1–9 on the keyboard 107, as shown in FIG. 1. The digit 5 is used for indicating a correct shot, i.e. a shot or a putt landing where intended, within some tolerance that may be subjective. The digit 8 will mean a straight but too long shot, while the digit 2 will mean a straight but too short shot. Similarly, the digits 4 and 6 will indicate shots of correct length, but 4 will indicate a leftward deviation and 6 will indicate a rightward deviation. Consequently, the digits 1, 3, 7 and 9 will indicate shots that are too short or too long, as well as having a leftward or rightward deviation, respectively. Preferably, the input of directional information on the registration unit 104 will be preceded by the depression of a key for that purpose on the keyboard 107, preparing the registration unit for the input of directional data.

Figure 13:
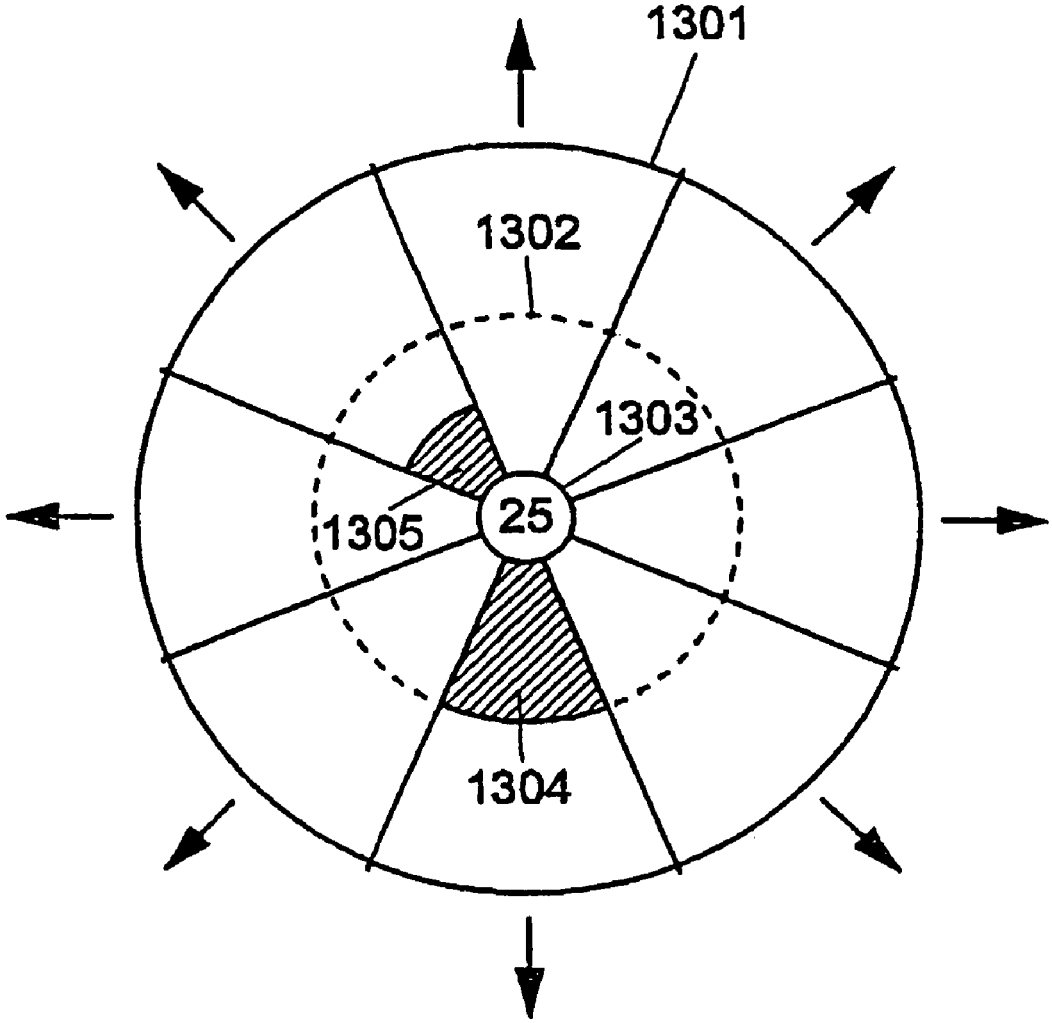
FIG. 13 shows an example of a presentation of input and processed directional data and distance data for a golf player.

FIG. 13 illustrates an example, according to one embodiment of the invention, of how input and processed length and direction data could be presented in the system. Assessment of the direction and length can be performed for all types of shots, and will preferably be presented for one shot type at a time. In FIG. 13, each sector represents an input with the above-mentioned keys 1–9. The outer ring 1301 represents 100% of the shots within the sector in question, whereas the dashed line 1302 represents 50%. In the inner circle 1303 is indicated, preferably by percentage figures, how large a portion of the illustrated shot type that was correct. From the figure it can be gathered that the player considered 25% of his shots, of the shot type in question, to be correct. It should be noted that this might be the case for putts, even if one has not made just one putt to reach the hole. A putt stopping e.g. wihtin half a metre from the hole could be considered as correct, if it was shot from maybe 5 metres or more. Furthermore, it may be gathered from FIG. 13 that the player has shot 50% of the shots straight but too short, indicated by the sector 1304 being filled up to the dashed line 1302. The remaining 25% of the shots have been too long and deviating towards the left, indicated by the sector 1305 being filled halfway to the line 1302. When selecting, from this analysis part presentation, to enter into the training part, the system will automatically give exercise suggestions for trying to overcome the registered problems. It will be understood that the presentation of direction data could also be performed by normal display of figures and text en clair.

Figure 15:
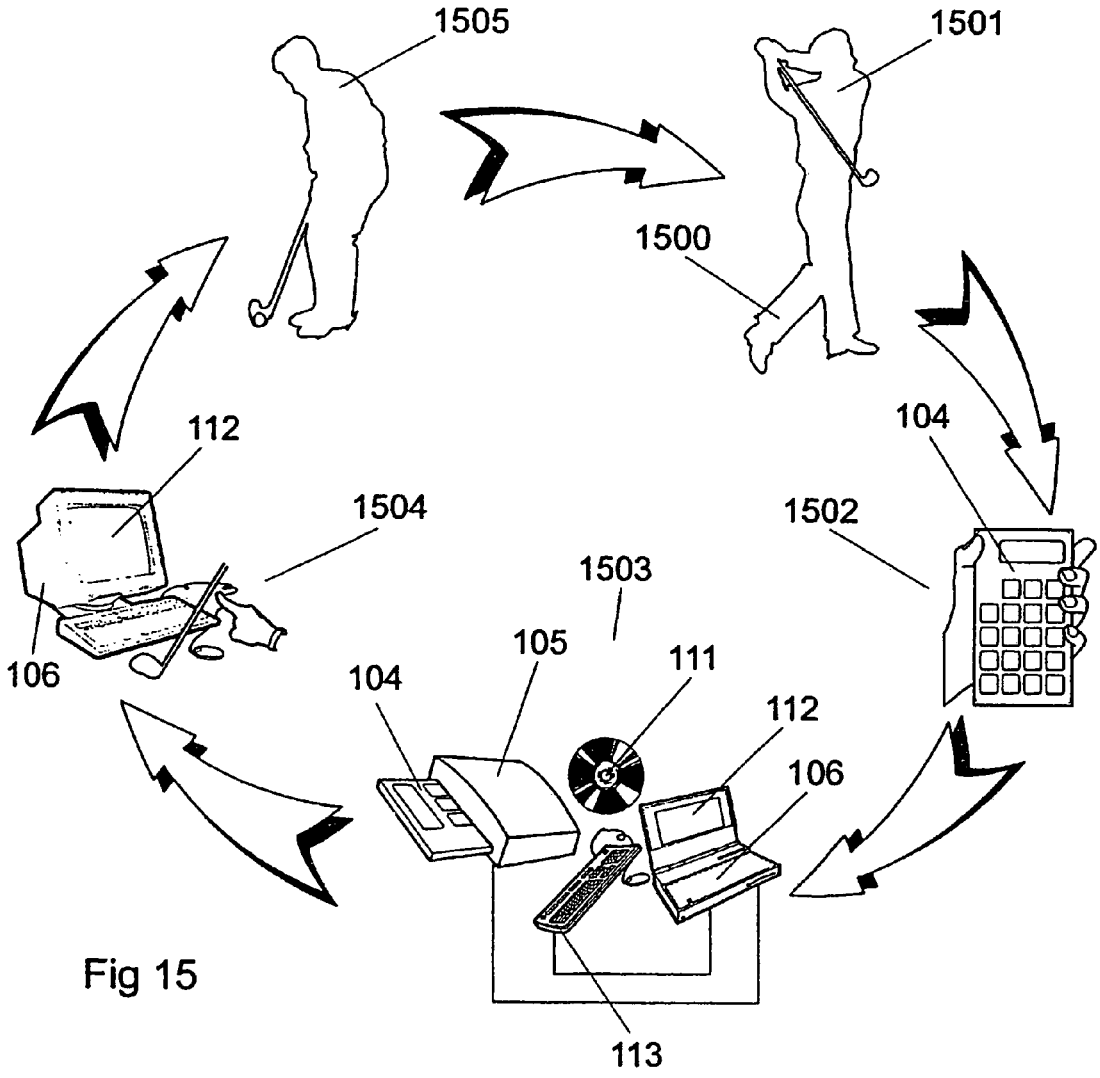
FIG. 15 shows a schematic illustration of one embodiment of the method according to the invention, for the example of golf.

FIG. 15 shows, schematically, the procedure for a preferred embodiment of the invention. A player 1500 plays, in step 1501, one or more golf rounds, whilst simultaneously registering his score in the registration unit 104, in step 1502. Into the unit 104, the player has also entered player data, such as sex, and number of extra shots given to him/her on the current course. The player 1500 will register the shot type for each shot and, in one embodiment, also if the player is satisfied or unsatisfied with the shot. The direction may also be registered, in the manner discussed above.

After finishing one round, or several rounds, the registered result data, together with the player data, are transferred to a computer 106, e.g. a PC, via an input device 105, or alternatively, the registered result data, together with the player data, are transferred directly to the Internet portal of the service provider via the input device 105. As mentioned above, the parameter processing unit may be functionally divided between the registering unit 104 and the computer 106. Thus, certain processing can be performed already in the registration unit 104, e.g. calculation of net score, allowing the registering unit to be used also as a traditional score card.

A keyboard and/or a mouse 113 are preferably connected to the computer 106. The data input device 105 is, in a preferred embodiment, an electronic pocket with a reader, in which pocket the registration unit 104 is placed, whereupon the information stored in the registration unit 104 is read, automatically or user-initiated, and stored in the computer 106. The reading may of course, in alternative embodiments, take place by wireless transmission, using IR, Bluetooth or similar.

On a storage medium 111, e.g. a CD-ROM or a server adapted for generating a portal, software is stored for actuating said computer 106 into performing the method according to the invention within the analysis and training parts of the system. The database 311 with reference profiles, and the database 316 with training models, may also be sorted on said storage medium 111, or may be accessible via a computer network, e.g. the Internet, from another storage location.

In the computer 106, the previously described analysis part can be performed and presented to the player on the display 112 or as a print-out. By means of the keyboard/mouse 113, the player may subsequently select to enter the training part 1504, whereby relevant exercises will be presented on the display 112. By studying the instructions and the figures being presented for each exercise step in the training part, the player may perform appropriate training in step 1505, whereupon he/she can come better prepared for the next round, or number of rounds, 1501. The system according to the present invention thus provides sports practisers with a heretofore not presented procedure for analysis and a training aid, in order to improve their game.

The FIGS. 10–12 show examples of characteristics profiles generated by an embodiment of the invention adapted for tennis. FIG. 10 shows how various shot types, such as forehand 1006, backhand 1008, first service 1010 and second service 1012, respectively, defined on the horizontal axis, are distributed percentage-wise with regard to successful shots in relation to unsuccessful shots for a current period. In the profile, a current result (bar marked 1) is compared with e.g. the player's own best score (bar marked 2) and that of an average player (bar marked 3) of for example the same sex, age group or ranking level.

In FIG. 11, the forehand shot of the player in question is characterised in the same manner, during the current match or period, concerning the percentage of winning shots (bar marked 1), missed shots (bar marked 2) and shots into the court (bar marked 3). In the diagram, these are also compared with those of an average player of the same sex, and possibly age group and e.g. ranking level, and in FIG. 12 the attack game of a tennis player is characterised in the same manner. The attack shot types illustrated are; after bouncing in the court, first volley, second volley and smash.

In an example of an embodiment not concerning sports, the invention could be applied to the stage of auditing journal writing within the health care sector. A person performing the audit, in this description called a quality auditor, will follow a nurse in his/her work regarding handling of patient's journals. The quality auditor carries a registration unit, preferably an electronic box, on which the auditor enters result data for given parameters, e.g. in the form of values entered by the numerical keyboard of the box, or in the form of Yes and No as answers to predetermined check points, which could be stated as questions on the inside of the casing of the box. Examples of questions might be:

Are the points in time stated in the journal readable?

Is the identity of the patient checked?

Does the nurse sign the journal?

After finishing the audit, the registered data are transferred to a PC, where a summary and statistics computation, in dependence of the result data, are performed by a profile generation device, whereupon the statistics is presented in the form of figures or diagrams. A comparison device in the PC then functions to compare the calculated statistics with a normal profile given in advance, e.g. an average taken from several different hospitals, or an average or a tendency curve for the current hospital based on previous journal audits.

The result of the analysis, i.e. the comparison with the normal profile, is subsequently used by a program in the computer, for selecting, among a multitude of pre-stored action programs for journal audits, an action program adapted for overcoming shortcomings detected by the performed comparison.

In a preferred embodiment within the area of journal audits, all audit results are stored on an Internet portal, where authorisation for access to the results is granted by certain responsible persons. For example, a national unit may have access to all the audits, whereas a department will only have access to their own audit results. A hospital manager has access to all the audits made in his hospital. In an alternative embodiment, the audit results can be stored in the hospital's central computer, and be transferred to other hospitals, authorities, etc., from there.

In one embodiment of the invention, which might be applied to both sports, administrative routines, education, etc., the action program comprises a test that is adapted to the detected shortcomings from the analysis part, e.g. a test of the kind where questions are to be answered verbally or in writing, or with multiple choice alternatives. The test is preferably executed on the practiser's computer 106 and is shown in the display 112 or played through a loudspeaker. The test may also be executed in a server arranged in a communication system, e.g. the Internet, to which the computer 106 may be connected. The test is then preferably accessible from the computer 106 via an Internet portal. Preferably, the computer/server software corrects the test, and the result is presented to the player on the display 112. The test result may also be presented as a player profile, which is weighted or presented together with a normal profile. The normal profile may represent a statistical entity within a given group, e.g. a school class, and may be an average, a minimum value or similar. In one embodiment of the invention, the step to be practised is represented by a theoretical test within a given subject. For each question or subject area, which are parameters, the practiser's reply is registered as result data in an input device 104, 105, 302. A calculation device 106, 304 is coupled to the input device and functioning to calculate, for each of said parameters, a characteristics measurement value for a predetermined characteristics measurement, in dependence of said result data. Such charactersitsics measurements could be the number of correct answers within a subject area, the percentage of completely correctly answered questiongs within the test, or similar. A profile generation device 106, 308, connected to said calculation device functions to generate a characteristics profile by compiling said calculated characteristics measurement values. A comparison device 312, connected to the profile generation device, is functioning to generate a comparison profile through comparing said characteristics profile with a pre-stored normal profile obtained from a reference database 311. The normal profile may be an average from a given group, e.g. a class, or be compiled data for the practiser obtained from previous tests, or similar. Preferably, a selection device 314 is connected to the profile generation device 308 and/or the comparison device 312 and/or a memory storage containing a profile data structure 310, and is devised to, in dependence of said characteristics profile or comparison profile, select a pre-stored action program for the practiser. The action program preferably consists of a series of exercises adapted to overcome the shortcomings detected by said comparison, and these exercises may be practical as well as theoretical.

It is to be understood that the described areas for the exemplifying embodiments, and for the different sports, are merely examples, and that a similar type of game parameters could be defined for other areas and other sports, such as darts, billiards and many others, and characteristics profiles be created, by application of the invention.

The invention claimed is:

1. A system for the registration and analysis of data from a practised stage, and for the generation of action programs in dependence of the performed analysis, the system comprising:

an input device for entering result data for one or more predetermined parameters from one or several performed stages;

a calculating device, connected to the input device and devised to calculate, for each of said parameters, a characteristics measurement value for a predetermined characteristics measurement, in dependence of said result data;

a profile generation device, connected to said calculation device and devised to generate a characteristics profile by compiling said calculated characteristics measurement values;

a reference database containing a pre-stored normal characteristics profile;

a comparison device, connected to the profile generation device and the reference database and devised to generate a comparison profile by comparing said characteristics profile with said pre-stored normal characteristics profile; and a selection device connected to the profile generation device or the comparison device or a memory containing a profile data structure, and being devised to select, in dependence of said characteristics profile or said comparison profile, from a multitude of pre-stored action programs, an action program adapted for overcoming shortcomings representative of said comparison profile;

wherein said characteristics profile is a profile for a practiser of said stage, whereas said normal characteristics profile is a profile calculated from a group of practisers with common properties;

wherein said practiser is a sports practiser, said stage being a game round of said sport, said parameter is a game parameter and said action program is a training model for improvement of the practiser's player properties within said sport; and wherein said system is adapted for the analysis of the player properties of a golfer, whereby the game parameters are various shot types and the characteristics measurement is the average number of shots per round.

2. A system for the registration and analysis of data from a practised stage, and for the generation of action programs in dependence of the performed analysis, the system comprising;

an input device for entering result data for one or more predetermined parameters from one or several performed stages;

a calculating device, connected to the input device and devised to calculate, for each of said parameters, a characteristics measurement value for a predetermined characteristics measurement, in dependence of said result data;

a profile generation device, connected to said calculation device and devised to generate a characteristics profile by compiling said calculated characteristics measurement values;

a reference database containing a pre-stored normal characteristics profile;

a comparison device, connected to the profile generation device and the reference database and devised to generate a comparison profile by comparing said characteristics profile with said pre-stored normal characteristics profile; and a selection device connected to the profile generation device or the comparison device or a memory containing a profile data structure, and being devised to select, in dependence of said characteristics profile or said comparison profile, from a multitude of pre-stored action programs, an action program adapted for overcoming shortcomings representative of said comparison profile;

wherein said characteristics profile is a profile for a practiser of said stage, whereas said normal characteristics profile is a profile calculated from a group of practisers with common properties;

wherein said practiser is a sports practiser, said stage being a game round of said sport, said parameter is a game parameter and said action program is a training model for improvement of the practiser's player properties within said sport; and wherein the system is adapted for the analysis of the player properties of a tennis player, whereby the game parameters are various shot types and the characteristics measurement is the percentage distribution of successful shots in relation to unsuccessful ones.

3. A computer program produce, for use together with a computer processing system, for the registration and analysis of data from a practised stage, and for the generation of action programs in dependence of the performed analysis, the product comprising:

a computer storage medium, including:

means, stored on the storage medium, for controlling the computer processing system to receive the input of result data for one ore more predetermined parameters from one or several performed stages;

calculating means, stored on the storage medium, for controlling the computer processing system to calculate, for each of said parameters, a characteristics measurement value for a predetermined characteristics measurement, in dependence of said result data;

profile generation means, stored on the storage medium, for controlling the computer processing system to generate a characteristics profile by compiling said calculated characteristics measurement values;

comparison means, stored on the storage medium, for controlling the computer processing system to generate a comparison profile by comparing said characteristics profile with a normal profile, pre-stored in a reference database; and selection means, stored on the storage medium, for controlling the computer processing system to select from a plurality of pre-stored action programs, in dependence of said characteristics profile or comparison profile, a pre-stored action program adapted for overcoming shortcomings representative of said comparison profile or said characteristics profile;

wherein said characteristics profile is a profile for a practiser of said stage, whereas said normal characteristics profile is a profile calculated from a group of practisers with common properties;

wherein said practiser is a sports practiser, said stage is one game round of said sport, said parameter is a game parameter and said action program is a training model for improvement of the practiser's player properties within said sport; and wherein the computer program product is adapted for the analysis of the player properties of a golfer, whereby the game parameters are various shot types and the characteristics measurement is the average number of shots per round.

4. A computer program product, for use together with a computer processing system, for the registration and analysis of data from a practised stage, and for the generation of action programs in dependence of the performed analysis, the product comprising:

a computer storage medium, including:

means, stored on the storage medium, for controlling the computer processing system to receive the input of result data for one ore more predetermined parameters from one or several performed stages;

calculating means, stored on the storage medium, for controlling the computer processing system to calculate, for each of said parameters, a characteristics measurement value for a predetermined characteristics measurement, in dependence of said result data;

profile generation means, stored on the storage medium, for controlling the computer processing system to generate a characteristics profile by compiling said calculated characteristics measurement values;

comparison means, stored on the storage medium, for controlling the computer processing system to generate a comparison profile by comparing said characteristics profile with a normal profile, pre-stored in a reference database; and selection means, stored on the storage medium, for controlling the computer processing systems to select from a plurality of pre-stored action programs, in dependence of said characteristics profile or comparison profile, a pre-stored action program adapted for overcoming shortcomings representative of said comparison profile or said characteristics profile;

wherein said characteristics profile is a profile for a practiser of said stage, whereas said normal characteristics profile is a profile calculated from a group of practisers with common properties;

wherein said practiser is a sports practiser, said stage is one game round of said sport, said parameter is a game parameter and said action program is a training model for improvement of the practiser's player properties within said sport; and wherein the computer program product is adapted for the analysis of the player properties of a tennis player, whereby the game parameters are various shot types and the characteristics measurement is the percentage distribution of successful shots in relation to unsuccessful ones.

5. A method for registering and analysing data from a practised stage, and for generating action programs in dependence of the performed analysis, the method comprising the steps of:

registering result data for one or more predetermined parameters from one or several performed stages;

calculating, for each of said parameters, a characteristics measurement value for a predetermined characteristics measurement;

generating a characteristics profile by compiling said calculated characteristics measurement values;

generating a comparison profile by comparing said characteristics profile with a pre-stored normal profile; and selecting, using at least one of said characteristics profile and said comparison profile, a pre-stored action program configured to convey to a practiser a plurality of steps or instructions directed toward converging (a) a subsequent characteristics profile, generated from characteristics measurement values calculated using data from at least one future practised stage, toward (b) said pre-stored normal profile;

wherein said characteristics profile is a profile for a practiser of said stage, whereas said normal characteristics profile is a profile calculated from a group of practisers with common properties;

wherein said practiser is a sports practiser, said stage is one game round of said sport, said parameter is a game parameter and said action program is a training model for improvement of the practiser's player properties within said sport; and wherein the method is adapted to the analysis of the player properties of a golfer, whereby the game parameters are various shot types and the characteristic measurement is the average number of shots per round.

6. A method for registering and analysing data from a practised stage, and for generating action programs in dependence of the performed analysis, the method comprising the steps of:

registering result data for one or more predetermined parameters from one or several performed stages;

calculating, for each of said parameters, a characteristics measurement value for a predetermined characteristics measurement;

generating a characteristics profile by compiling said calculated characteristics measurement values;

generating a comparison profile by comparing said characteristics profile with a pre-stored normal profile; and selecting, using at least one of said characteristics profile and said comparison profile, a pre-stored action program configured to convey to a practiser a plurality of steps or instructions directed toward converging (a) a subsequent characteristics profile, generated from characteristics measurement values calculated using data from at least one future practised stage, toward (b) said pre-stored normal profile;

wherein said characteristics profile is a profile for a practiser of said stage, whereas said normal characteristics profile is a profile calculated from a group of practisers with common properties;

wherein said practiser is a sports practiser, said stage is one game round of said sport, said parameter is a game parameter and said action program is a training model for improvement of the practiser's player properties within said sport; and wherein said method is adapted to the analysis of the player properties of a tennis player, whereby the game parameters are various shot types and the characteristic measurement is the percentage distribution of successful shots in relation to unsuccessful ones.

7. A system for the registration and analysis of data from a practised game round of a sport, and for the generation of action programs based on the performed analysis, the system comprising:

a data input configured to accept result data of one or more predetermined game parameters from one or more game rounds played or practiced by a sports practiser;

a calculator, linked to the data input and configured to determine, for each of said game parameters, a characteristics measurement relating to a predetermined characteristics measurement based on said result data;

a profiler, linked to said calculator, and configured to generate a characteristics profile using said calculated characteristics measurement;

a database storing a reference characteristics profile for a reference practiser of said sport, or a reference group of practisers with a plurality of common characteristics;

a comparator, linked to the profiler and the database, and configured to generate a comparison profile by comparing said characteristics profile with said reference characteristics profile;

a selector linked to the profiler and/or the comparator and/or a memory in which a profile data structure is storable, and configured to select from a group comprised of a plurality of pairs of training models, based on one of said characteristics profile and said comparison profile, one of said training models configured to convey to said sports practiser a plurality of steps or instructions intended to improve said sport practisers' performance in a subsequent game round;

wherein said data input comprises a keypad having a plurality of pairs of keys via which said result data is manually entered, said calculator comprises a processor configured to determine by calculation each said characteristic measurement wherein said charactersitsic measurement is calculated for said predetermined characteristics measurement, said profile comprises a processor configured to generate said characteristics profile via compilation of said calculated characteristics measurement, said database comprises a data storage unit that holds said reference characteristics profile which is pre-stored therein before said selector selects said training model, said comparator comprises a processor configured to generate said comparison profile by comparing said characteristics profile with said reference characteristics profile, and said selector comprises a processor configured to select said training model using one of said characteristics profile and said comparison profile; wherein at least one of said links comprises a non-wireless electrically digital data signal conducting connection;

wherein selection of said action program is automatic; and wherein each said processor comprises a common processor onboard a hand-held registration unit;

the system further comprising a personal computer and a link enabling said hand-held registration unit to removably connect to said personal computer.

8. A system for the registration and analysis of data from a practised game round of a sport, and for the generation of action programs based on the performed analysis, the system comprising:

a data input configured to accept result data of one or more predetermined game parameters from one or more game rounds played or practised by a sports practiser;

a calculator, linked to the data input and configured to determine, for each of said game parameters, a characteristics measurement relating to a predetermined characteristics measurement based on said result data;

a profiler, linked to said calculator, and configured to generate a characteristics profile using said calculated characteristics measurement;

a database storing a reference characteristics profile for a reference practiser of said sport, or a reference group of practisers with a plurality of common characteristics;

a comparator, linked to the profiler and the database, and configured to generate a comparison profile by comparing said characteristics profile with said reference characteristics profile;

a selector linked to the profiler and/or the comparator and/or a memory in which a profile data structure is storable, and configured to select from a group comprised of a plurality of pairs of training models, based on one of said characteristics profile and said comparison profile, one of said training models configured to convey to said sports practiser a plurality of steps or instructions intended to improve said sport practisers' performance in a subsequent game round;

wherein said data input comprises a keypad having a plurality of pairs of keys via which said result data is manually entered, said calculator comprises a processor configured to determine by calculation each said characteristic measurement wherein said characteristic measurement is calculated for said predetermined characteristics measurement, said profiler comprises a processor configured to generate said characteristics profile via compilation of said calculated characteristics measurement, said database comprises a data storage unit that holds said reference characteristics profile which is pre-stored therein before said selector selects said training model, said comparator comprises a processor configured to generate said comparison profile by comparing said characteristics profile with said reference characteristics profile, and said selector comprises a processor configured to select said training model using one of said characteristics profile and said comparison profile, wherein at least one of said links comprises a non-wireless electrically digital data signal conducting connection, wherein selection of said action program is automatic; and wherein said data input is comprised of a hand-held unit;

the system further comprising a personal computer wherein said processor of at least one of said calculator, said profiler, comparator and said selector is disposed onboard said hand-held unit and said processor of at least one other of said calculator, said profiler, comparator and said selector is disposed onboard said personal computer with at least one of said links linking said hand-held unit and said personal computer.

* * * * *